US006187735B1

(12) United States Patent
Gambogi et al.

(10) Patent No.: US 6,187,735 B1
(45) Date of Patent: Feb. 13, 2001

(54) LIGHT DUTY LIQUID DETERGENT

(75) Inventors: Joan Gambogi, Belle Mead, NJ (US); Patrick Durbut, Verviers; Guy Broze, Grace-Hollogne, both of (BE); Leonard Zyzyck, Skillman, NJ (US)

(73) Assignee: Colgate-Palmolive Co, Ascataway, NJ (US)

( * ) Notice: Under 35 U.S.C. 154(b), the term of this patent shall be extended for 0 days.

(21) Appl. No.: 09/566,153

(22) Filed: May 5, 2000

(51) Int. Cl.[7] ..... C11D 1/75; C11D 1/62; C11D 1/645; C11D 1/835; C11D 3/30

(52) U.S. Cl. ..... 510/237; 510/423; 510/433; 510/434; 510/470; 510/502; 510/503; 510/504; 510/488; 510/506; 510/508

(58) Field of Search ..... 510/237, 423, 510/433, 434, 470, 502, 503, 504, 506, 508, 488

(56) References Cited

U.S. PATENT DOCUMENTS

| | | | | |
|---|---|---|---|---|
| 5,728,667 | * | 3/1998 | Richter | 510/235 |
| 5,798,329 | * | 8/1998 | Taylor et al. | 510/384 |
| 5,922,662 | * | 7/1999 | Thomas | 510/235 |

* cited by examiner

*Primary Examiner*—Greg R. Del Cotto
(74) *Attorney, Agent, or Firm*—Richard E. Nanfeldt

(57) ABSTRACT

A light duty, liquid comprising: cationic ammonium compound, an amine oxide, a $C_{12}$–$C_{14}$ fatty acid monoalkanol amide, a disinfecting agent, and water. The compositions are high foaming, have excellent grease cutting ability, and mildness to human skin.

8 Claims, No Drawings

LIGHT DUTY LIQUID DETERGENT

BACKGROUND OF THE INVENTION

The present invention relates to novel light duty liquid detergent compositions with high foaming properties, disinfecting properties and good grease cutting properties.

The prior art is replete with light duty liquid detergent compositions containing nonionic surfactants in combination with anionic and/or betaine surfactants wherein the nonionic detergent is not the major active surfactant. In U.S. Pat. No. 3,658,985 an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8 to 20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition containing an alkali metal silicate, urea, glycerin, triethanolamine, an anionic detergent and a nonionic detergent. The silicate content determines the amount of anionic and/or nonionic detergent in the liquid cleaning composition. However, the foaming properties of these detergent compositions are not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to affect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylenepolyoxyethylene nonionic detergent, an anionic surfactant, a fatty acid alkanolamide and a polyoxyalkylene glycol fatty ester. But, none of the exemplified compositions contain an active ingredient mixture wherein the nonionic detergent is present in major proportion which is probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a high foaming, disinfecting liquid cleaning composition can be formulated with a cationic ammonium compound, an amine oxide, a fatty acid monoalkanolamide, a disinfecting agent and water and, optionally, a nonionic surfactant selected from the group of ethoxylated nonionic surfactant, ethoxylated/propoxylated nonionic surfactant and a magnesium containing inorganic compound and an alkyl polyglucoside surfactant and mixtures thereof. The compositions have excellent grease cutting ability and mildness to the human skin.

To achieve the foregoing and other objects and in accordance with the purpose of the present invention, as embodied and broadly described herein the novel, high foaming, light duty liquid detergent of this invention comprises a cationic ammonium compound, a fatty acid monoalkanol amide, an amine oxide, a disinfecting agent and water and optionally a nonionic surfactant selected from the group of ethoxylated nonionic surfactant, ethoxylated/propoxylated nonionic surfactant, a magnesium containing inorganic compound, and an alkyl polyglucoside surfactant and mixtures thereof wherein the composition does not contain any anionic surfactant, a glycol ether solvent, a zwitterionic surfactant, a mono- or di-saccharides a polyoxyalkylene glycol, fatty acid, a builder, a polymeric thickener, an acid, a clay, abrasive, silicas, tricloscan, alkaline earth metal carbonates, alkyl glycine surfactant, cyclic imidinium surfactant, or more than 0.2 wt. % of a perfume or water insoluble hydrocarbon.

DETAILED DESCRIPTION OF THE INVENTION

The present invention relates to a light duty liquid detergent which comprises approximately by weight:

(a) 2% to 34% of a cationic ammonium compound;

(b) 0.5% to 8% of a $C_{12}$–$C_{14}$ fatty acid monoalkanolamide;

(c) 0 to 30% of an ethoxylated and/or propoxylated nonionic surfactant;

(d) 2% to 8% of a disinfecting agent;

(e) 0.25% to 13% of magnesium containing inorganic compound; and (f) 0 to 20% of an alkyl polyglucoside surfactant;

(g) 3% to 24%, more preferably 5% to 22% of an amine oxide surfactant;

(h) the balance being water wherein the composition does not contain a glycol ether solvent, an anionic surfactant, a zwitterionic surfactant, a polyoxyalkylene glycol fatty acid, a mono- or di-saccharides, a builder, a polymeric thickener, a clay, abrasive, silicas, triclosan, alkaline earth metal carbonates, alkyl glycine surfactant, cyclic imidinium surfactant, or more than 0.3 wt. % of a perfume or water insoluble hydrocarbon.

The instant compositions contain about 2 to about 34 wt. % of a cationic ammonium compound such as a $C_{14}$–$C_{18}$ alkyl trimethyl ammonium chloride, most preferably $C_{16}$ alkyl trimethyl ammonium chloride.

The amine oxides used at a concentration of 3 to 24 wt. %, more preferably 5 wt. % to 22 wt. % in forming the light duty liquid compositions are depicted by the formula:

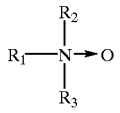

wherein $R_1$ is a $C_{10}$–$C_{18}$ a linear or branched chain alkyl group, $R_2$ is a $C_1$–$C_{16}$ linear alkyl group and $R_3$ is a $C_1$–$C_{16}$ linear alkyl group, or the amido radical:

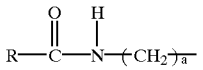

wherein R is an alkyl group having about 9 to 19 carbon atoms and a is the integer 1 to 4: $R_2$ and $R_3$ are each alkyl groups having 1 to 3 carbons and preferably 1 carbon.

The instant compositions contain about 2 to about 8 wt. %, more preferably 3 to 5 wt. % of a disinfectant agent selected from the group consisting of $C_8$–$C_{16}$ alkyl amines, $C_8$–$C_{16}$ alkyl benzyl dimethyl ammonium chlorides, $C_8$–$C_{16}$ dialkyl dimethyl ammonium chlorides, $C_8$–$C_{14}$ alkyl dimethyl ammonium chloride, a $C_8$–$C_{12}$ alkyl trimethyl ammonium chloride, and chlorhexidine and mixtures thereof. Some typical disinfectant agent useful in the instant compositions are manufactured by Lonza, S.A. They are: Bardac 2180 (or 2170) which is N-decyl-N-isonoxyl-N, N-dimethyl ammonium chloride; Bardac 22 which is didecyl dimethyl ammonium chloride; Bardac LF which is N,Ndioctyl-N, N-dimethyl ammonium chloride; Bardac 114 which is a mixture in a ratio of 1:1:1 of N-alkyl-N, N-didecyl-N, N-dimethyl ammonium chloride/N-alkyl-N, N-dimethyl-N-ethyl ammonium chloride; and Barquat MB-50 which is N-alkyl-N, N-dimethyl-N-benzyl ammonium chloride. Another disinfecting agent is dimethyl benzyl alkonium chloride (BASF).

The nonionic surfactant can be optionally used in the cleaning composition in amounts of 0 to 30 wt. %, preferably 8 wt. % to 22 wt. %.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic surfactants generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing 8 to 18 carbon atoms in a straight or branched chain configuration) condensed with 5 to 30 moles of ethylene oxide, for example, lauryl or myristyl alcohol condensed with 16 moles of ethylene oxide (EO), tridecanol condensed with 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohols containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of 8–15 and give good/W emulsification, whereas ethoxamers with HLB values below 8 contain less than 5 ethyleneoxy groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-1 2) marketed by Union Carbide.

Other suitable nonionic detergents include the polyethylene oxide condensates of one mole of alkyl phenol containing from 8 to 18 carbon atoms in a straight- or branched chain alkyl group with 5 to 30 moles of ethylene oxide. Specific examples of alkyl phenol ethoxylates include nonyl condensed with 9.5 moles of EO per mole of nonyl phenol, dinonyl phenol condensed with 12 moles of EO per mole of phenol, dinonyl phenol condensed with 15 moles of EO per mole of phenol and di-isoctylphenol condensed with 15 moles of EO per mole of phenol. Commercially available nonionic surfactants of this type include Igepal CO-630 (nonyl phenol ethoxylate) marketed by GAF Corporation.

Also among the satisfactory nonionic detergents are the water-soluble condensation products of a $C_8$–$C_{20}$ alkanol with a heteric mixture of ethylene oxide and propylene oxide wherein the weight ratio of ethylene oxide to propylene oxide is from 2.5:1 to 4:1, preferably 2.8:1–3.3:1, with the total of the ethylene oxide and propylene oxide (including the terminal ethanol or propanol group) being from 60–85%, preferably 70–80%, by weight. Such detergents are commercially available from BASF-Wyandotte and a particularly preferred detergent is a $C_{10}$–$C_{16}$ alkanol condensate with ethylene oxide and propylene oxide, the weight ratio of ethylene oxide to propylene oxide being 3:1 and the total alkoxy content being 75% by weight.

Other suitable water-soluble nonionic detergents which are less preferred are marketed under the trade name "Pluronics." The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants will be in liquid form and satisfactory surfactants are available as grades L62 and L64.

The instant compositions can contain about 0 to about 20 wt. %, more preferably about 5 to 15 wt. % of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucosde content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The instant composition contains a $C_{12-14}$ fatty acid monoalkanol amide such as lauryl monoalkanol amide wherein the concentration of the fatty acid monoalkanol amide is 0.5 to 8 wt. %, preferably 1.0 to 6 wt. %.

The instant compositions can contain 1 wt. % to 15 wt. %, more preferably 0.1 wt. % to 8 wt. % of a solubilizing agent which is selected from the group consisting of $C_1$–$C_4$ alkanols such as ethanol, alkali metal halides such as sodium chloride and mixtures thereof. Various other ingredients such as urea at a concentration of 0.5 to 4.0 wt. % or urea at the same concentration in combination with ethanol at a concentration of 0.5 to 4.0 wt. % can be used as solubilizing agents. Other ingredients which have been added to the compositions at concentrations of 0.1 to 4.0 wt. percent are perfumes, sodium bisulfite, ETDA, isoethanoeic acid and proteins such as lexine protein. The foregoing solubilizing ingredients also facilitate the manufacture of the inventive compositions because they tend to inhibit gel formation.

The water is present at a concentration of 40 wt. % to 98 wt. %.

A proton donating agent can be optionally used at a concentration of 0 to 4 wt. %, more preferably 0.1 wt. % to 3 wt. %, wherein the proton donating agent is selected from the group consisting of hydroxy containing organic acids such as lactic acid, citric acid or ortho hydroxy benzoic acids and inorganic acids such as hydrochloric acid or sulfuric acid and mixtures thereof.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pH modifiers; etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a perservative at a concentration of 0.1 to 4.0 wt. %. Sodium bisulfite can be used as a color stabilizer at a concentration of 0.01 to 0.2 wt.%.

The present light duty liquid detergents such as dishwashing liquids are readily made by simple mixing methods from readily available components which, on storage, do not adversely affect the entire composition. Solubilizing agent such as ethanol, and/or sodium chloride are used to assist in solubilizing the surfactants. The viscosity of the light duty liquid composition desirably will be at least 100 centipoises (cps) at room temperature, but may be up to 1,000 centipoises as measured with a Brookfield Viscometer using a number 21 spindle rotating at 20 rpm. The viscosity of the light duty liquid composition may approximate those of commercially acceptable light duty liquid compositions now on the market. The viscosity of the light duty liquid composition remain stable on storage for lengthy periods of time, without color changes or settling out of any insoluble materials. The pH of the composition is about 5 to 8, more preferably about 7.0. The pH of the composition can be adjusted by the addition of $Na_2O$ (caustic soda) to the composition.

The instant compositions have a minimum foam volume of 350 mis after 40 rotation at 25° C. as measured by the foam volume test using 0.033 wt. % of the composition in 150 ppm of water. The foam test is an inverted cylinder test in which 100 ml. of a 0.033 wt. % LDL formula in 150 ppm of $H_2O$ is placed in a stoppered graduate cylinder (500 ml) and inverted 40 cycles at a rate of 30 cycles/minute. After 40 inversions, the foam volume which has been generated is measured in mis inside the graduated cylinder. This value includes the 100 ml of LDL solution inside the cylinder.

The instant formulas explicitly exclude alkali metal silicates and alkali metal builders such as alkali metal polyphosphates, alkali metal carbonates, alkali metal phosphonates and alkali metal citrates because these materials. If these builders were used in the instant composition, they would cause the composition to have a high pH as well as leaving residue on the surface being cleaned.

The following examples illustrate liquid cleaning compositions of the described invention. Unless otherwise specified, all percentages are by weight. The exemplified compositions are illustrative only and do no limit the scope of the invention. Unless otherwise specified, the proportions in the examples and elsewhere in the specification are by weight.

DESCRIPTION OF THE PREFERRED EMBODIMENTS

Example 1

The following formulas were prepared at room temperature by simple liquid mixing procedures as previously described and tested.

| | A | B | C | D | Control 1 | Control 2 |
|---|---|---|---|---|---|---|
| Cetyl trimethyl ammonium chloride | 18 | 28 | 10 | 5 | | |
| Cocoamido propyl amine oxide | 18 | 8 | 10 | 5 | | |
| Lauryl myristyl monoethanol amide | 4 | 4 | 3 | 3 | | |
| Ethoxylated isodecyl alcohol | — | — | 20 | 20 | | |
| APG625 | — | — | — | 10 | | |
| BTC888 (n-alkyl dimethyl benzyl ammonium chloride and dialkyl dimethyl ammonium chloride) | 4 | 4 | 4 | 4 | | |
| Foam volume without soil (ml) | 443 | 450 | 415 | 390 | 442 | 403 |
| Foam volume with soil (ml) | 217 | 218 | 160 | 132 | 238 | 158 |
| Foam torture test: | | | | | | |
| Initial (ml) | 468 | 468 | 440 | 427 | 450 | 437 |
| Final (ml) | 330 | 342 | 278 | 262 | 285 | 267 |
| Cup tallow removal (%) | 23 | 18 | 9 | 12 | 1 | 7 |
| Use Dilution Test (10% dilution, 1 minute contact time) | | | | | | |
| *Staph aureus* | 0/10 | | 0/20 | 1/10 | | |
| Salmonella | 0/10 | | 0/20 | 0/10 | | |
| Frosch-Kligman Skin Clinical | | | | | | |
| Erythema (5 day) | 1.00 | | 0.60 | 0.38 | 2.16 | |
| Dryness (8 Day) | 0.90 | | 0.58 | 0.30 | 1.20 | |

The cup test consists of solidifying about 6.5 g of beef tallow in the bottom of a polypropylene cup. Warm (115 F.), dilute solutions (2.67 g/L) of the test products are poured into the soiled cups and allowed to soak for 15 minutes. The % grease removal is determined after drying.

Disinfectancy was assessed using the Use Dilution Test, with either 10 or 20 carriers each of Staph aureus and Salmonella (reference AOAC, 14th Edition, 1984, Use Dilution Methods).

Mildness to the hands was assessed clinically with the Frosch-Kligman Skin Clinical, literature reference *J. Am. Acad. Dermatol.,* 1:35–41, 1979. Higher scores indicate more redness and dryness.

What is claimed is:

1. A light duty liquid detergent composition comprising approximately by weight:

(a) 2% to 34% of a $C_{14}$–$C_{18}$ alkyl trimethyl ammonium chloride;

(b) 2% to 8% of a disinfecting agent selected from the group consisting of $C_8$–$C_{16}$ alkyl amines, $C_8$–$C_{16}$ alkyl benzyl dimethyl ammonium chlorides, $C_8$–$C_{16}$ dialkyl dimethyl ammonium chlorides, $C_8$–$C_{12}$ alkyl trimethyl ammonium chlorides, and chlorohexadine and mixtures thereof;

(c) 3% to 24% of an amine oxide;

(d) 0.5% to 8% of a $C_{12}$–$C_{14}$ fatty acid monoalkanol amide; and (e) the balance being water, wherein the composition does not contain any anionic surfactant, zwitterionic surfactant, a glycol ether, a mono- or di-saccharide, a polyoxyalkylene glycol, a fatty acid, a builder, a polymeric thickener, a clay, an abrasive, silicas, triclosan, alkaline earth metal carbonates, alkyl glycine surfactant, cyclic imidinium surfactant, and more than 0.2 wt % of a perfume or water insoluble hydrocarbon.

2. A light duty liquid composition according to claim 1 further comprising 1% to 15% by weight of a solubilizing agent which is selected from the group consisting of $C_1$–$C_4$ alkanol and alkali metal halides and mixtures thereof.

3. A light duty liquid composition according to claim 1 further comprising a preservative.

4. A light duty liquid composition according to claim 1 further comprising a color stabilizer.

5. A light duty liquid cleaning composition according to claim 1 further comprising ethoxylated and/or an ethoxylated/propoxylated nonionic surfactant.

6. A light duty liquid cleaning composition according to claim 5 further comprising an alkyl polyglucoside surfactant.

7. A light duty liquid composition according to claim 1 further comprising a proton donating agent selected from the group consisting of hydroxy containing organic acids and inorganic acids and mixtures thereof.

8. A light duty liquid composition according to claim 1 further comprising a magnesium containing inorganic compound.

* * * * *